United States Patent [19]

Hamada et al.

[11] Patent Number: 5,072,975

[45] Date of Patent: Dec. 17, 1991

[54] SWITCH BOX OF LOCK DEVICE FOR VEHICLE

[75] Inventors: Yoshikazu Hamada; Yozo Ogino; Katsuya Ashizawa, all of Utsunomiya, Japan

[73] Assignee: Mitsui Kinzoku Kogyo Kabushiki Kaisha, Tokyo, Japan

[21] Appl. No.: 515,944

[22] Filed: Apr. 27, 1990

[30] Foreign Application Priority Data

Apr. 27, 1989 [JP] Japan ..... 1-108457
Jun. 28, 1989 [JP] Japan ..... 1-166429

[51] Int. Cl.[5] ..... F05C 3/26

[52] U.S. Cl. ..... 292/201; 200/61.64; 200/61.68; 292/337

[58] Field of Search ..... 200/61.64, 61.67, 61.68; 292/201, 216, 337

[56] References Cited

U.S. PATENT DOCUMENTS

| | | | |
|---|---|---|---|
| 4,249,161 | 2/1981 | Mohnhaupt | 200/61.67 |
| 4,538,845 | 9/1985 | Yamada | 292/216 |
| 4,735,447 | 4/1988 | Kleefeldt | 292/201 |
| 4,796,932 | 1/1989 | Tame | 292/201 |
| 4,806,712 | 2/1989 | Hoffman et al. | 200/61.64 |
| 4,814,557 | 3/1989 | Kato | 200/61.64 |
| 4,892,340 | 1/1990 | Matumoto | 292/201 |
| 4,898,414 | 2/1990 | Yamada | 292/201 |

FOREIGN PATENT DOCUMENTS 206582 8/1988 Japan .

*Primary Examiner*—Eric K. Nicholson
*Attorney, Agent, or Firm*—Browdy and Neimark

[57] ABSTRACT

A lock device for a vehicle in accordance with the present invention comprises a synthetic resin body; a recess formed on the surface side of the body and storing a latch meshing switch a striker; a swell portion formed on the back side of the body, having a C-shaped sectional shape and partitioning by its inner wall a guide groove of the striker; an enclosure wall formed integrally with the body at a position above the upper wall of the swell portion on the back side of the body; and a box defined between the lower surface of the enclosure wall and the upper wall of the swell portion. A switch for detecting the rotating position of the latch is stored inside the box. A metallic back plate is fixed to the back side of the body and a cover for covering the back side of the box is formed integrally with the metallic back plate. A protuberance projecting into the box is provided to the latch. The switch has a plurality of contact surfaces connected to cords, a rotary contact for short-circuiting the contact surfaces with one another and a spring for pushing the rotary contact to the contact surfaces.

4 Claims, 6 Drawing Sheets

SWITCH BOX OF LOCK DEVICE FOR VEHICLE

FIELD OF THE INVENTION

This invention relates to a switch box of a lock device for a vehicle. More particularly, the present invention relates to a fitting box of a switch for detecting the latch position of a lock device. This switch is used for controlling a room lamp, a passive seat belt, and so forth.

DESCRIPTION OF THE PRIOR ART

Japanese Patent Laid-Open No. 206582/1988 discloses a lock device for a vehicle which includes a recess formed on the surface side of a synthetic resin body, a latch disposed rotatably inside the recess and meshing with a striker fixed to a car body and a switch for detecting the rotating position of the latch. A box for fitting the switch is disposed on the back of the latch. First, the switch is fitted into the box and then the latch is fitted on the upper side in such a manner as to superpose with the former. Therefore, a great deal of trouble is necessary for assembly and maintenance of the switch is by no means easy.

On the other hand, a lock device wherein the switch described above is juxtaposed with the latch on the same plane is also known in the art. However, this structure involves the drawback that a large recess is necessary and consequently, the body becomes relatively greater.

SUMMARY OF THE INVENTION

It is therefore an object of the present invention to provide a lock device for a vehicle which facilitates the assembly of the switch by forming a box for fitting the switch on the back side of the body.

It is another object of the present invention to provide a compact switch which will be suitable for the storage inside the box described above.

DESCRIPTION OF THE PREFERRED EMBODIMENT

Figure 1:
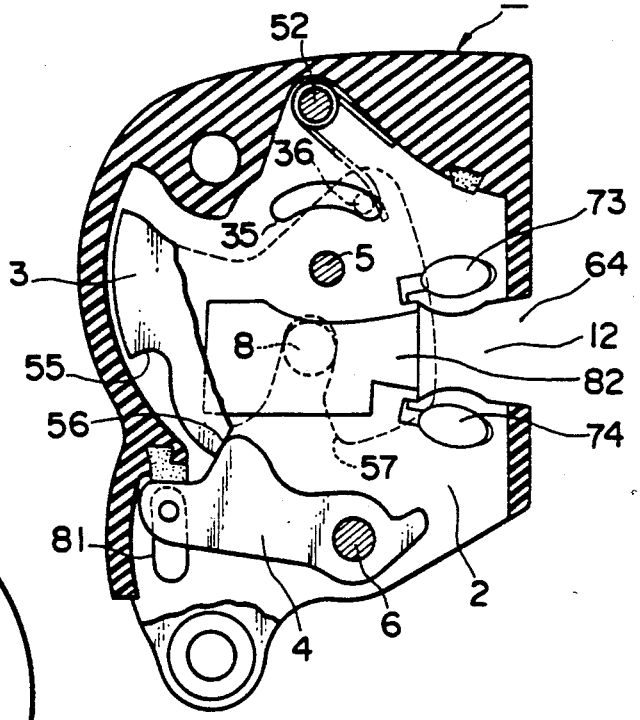
FIG. 1 is a longitudinal sectional front view of the body of a lock device in accordance with the present invention.

Hereinafter, an embodiment of the present invention will be described with reference to the accompanying drawings. A recess 2 is formed on the front side of a synthetic resin body 1 of a lock device which is fixed to a door, and a swell portion 13 is formed on its back side. A latch 3 meshing with a striker 8 fixed to a car body is fitted rotatably inside the recess 2 by a shaft 5 and a ratchet 4 meshing with steps 55, 56 of the latch 3 is disposed also rotatably inside the recess 2 by a shaft 6 so as to prevent reverse rotation of the latch 3.

Figure 5:
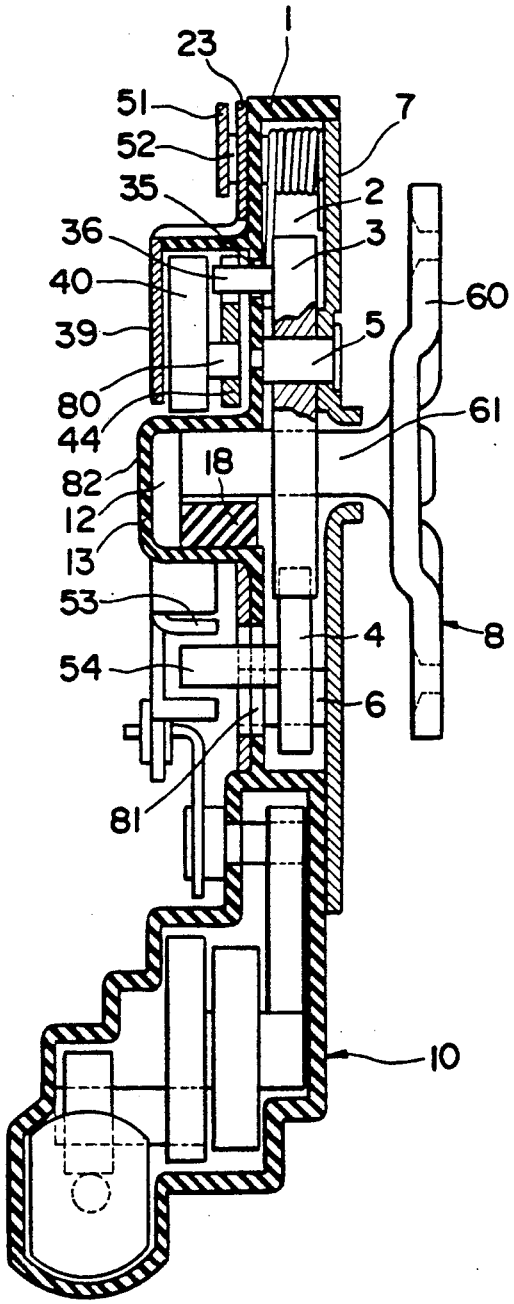
FIG. 5 is a longitudinal sectional side view of the lock device.

As shown in FIG. 5, the striker 8 consists of a vertical plate 60 fixed to the car body side and a rod 61 fixed at right angles to the vertical plate 60. The rod 61 is U-shaped as a whole and consists of a front leg portion 21 having a small diameter and meshing with an engagement groove 57 of the latch 3, a rear leg portion 22 having a large diameter and a bridge portion 11 connecting the tips of these leg portions 21 and 22 to each other. The bridge portion 11 has a wedge-like shape whose front side is thin and whose rear side is thick. The bridge portion 11 enters the body through a guide groove 12 which is defined by the inner wall of the swell portion 13 described above.

Figure 4:
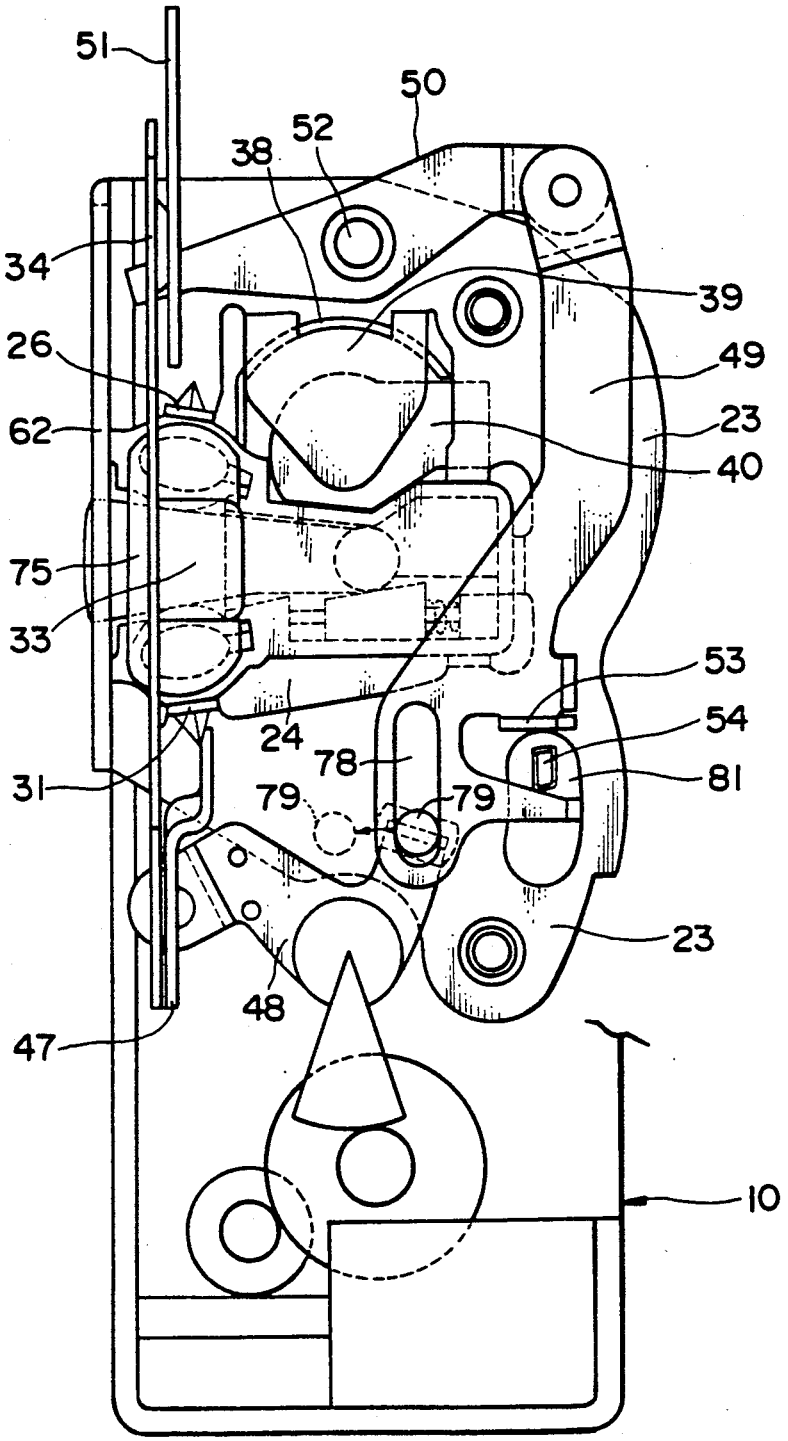
FIG. 4 is a rear view of the lock device.
Figure 6:
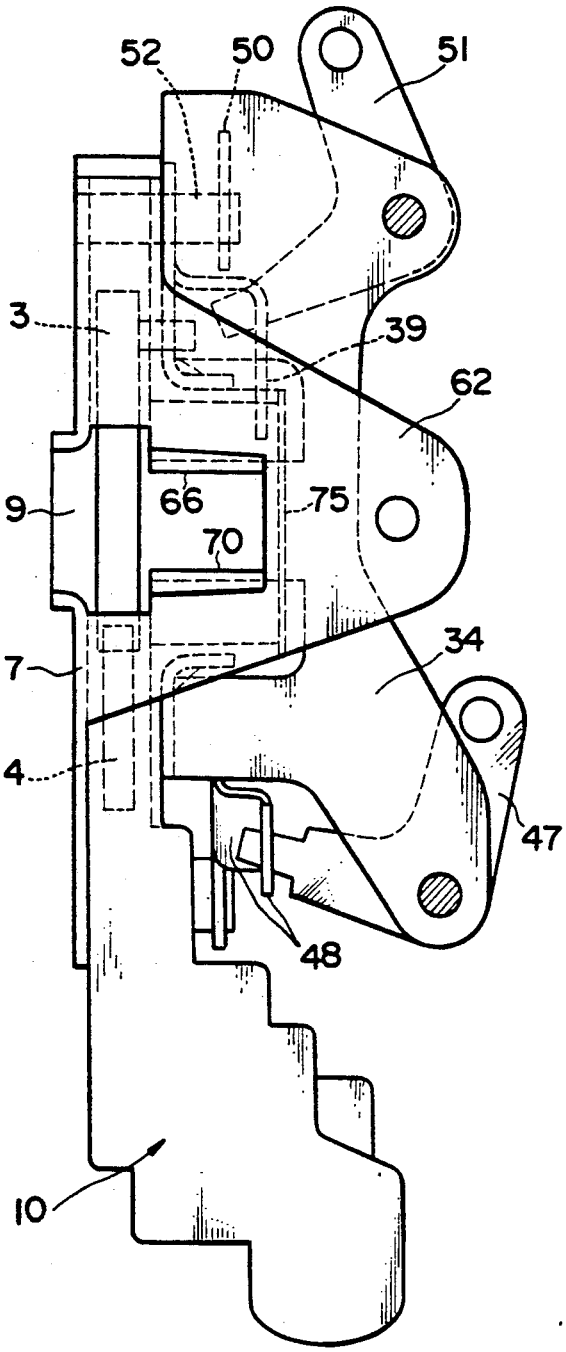
FIG. 6 is a right-hand side view of the lock device.

An actuator 10 is disposed sometimes at the lower part of the body 1, whenever necessary in accordance with the intended application, as shown in FIGS. 4 through 6.

A metallic plate 7 for covering the recess 2 is fixed to the front side of the body 1. The cover plate 7 has a side plate 62 which is bent at right angles (FIG. 6) and exhibits an L-shape as a whole. A notch groove 9 is defined at the portion of the plate 7 where the striker 8 passes.

Figure 7:
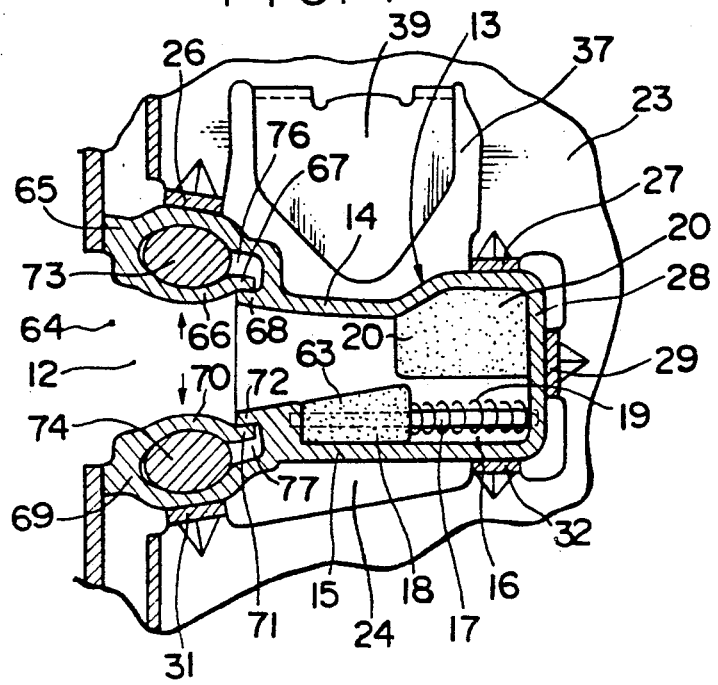
FIG. 7 is a sectional view of a guide groove of the body when the door is open.
Figure 8:
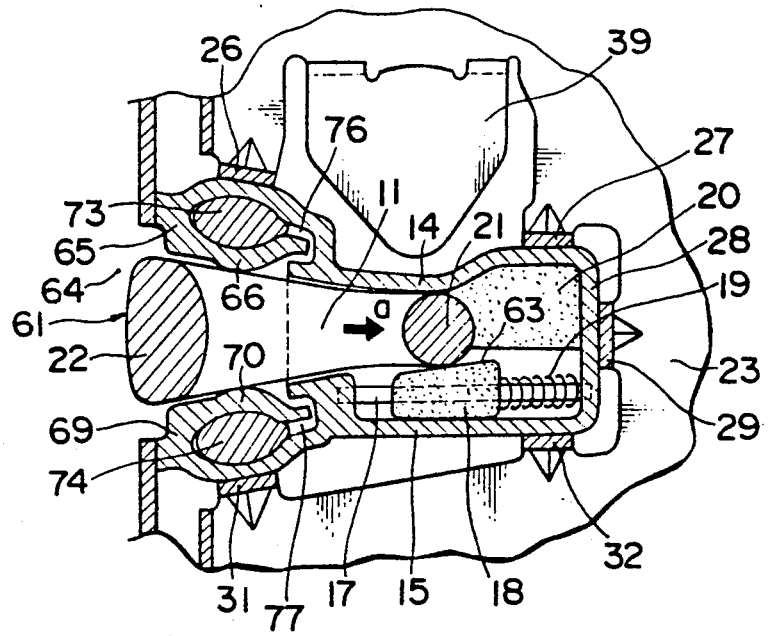
FIG. 8 is a sectional view of the guide groove of the body when the door is closed.
Figure 9:
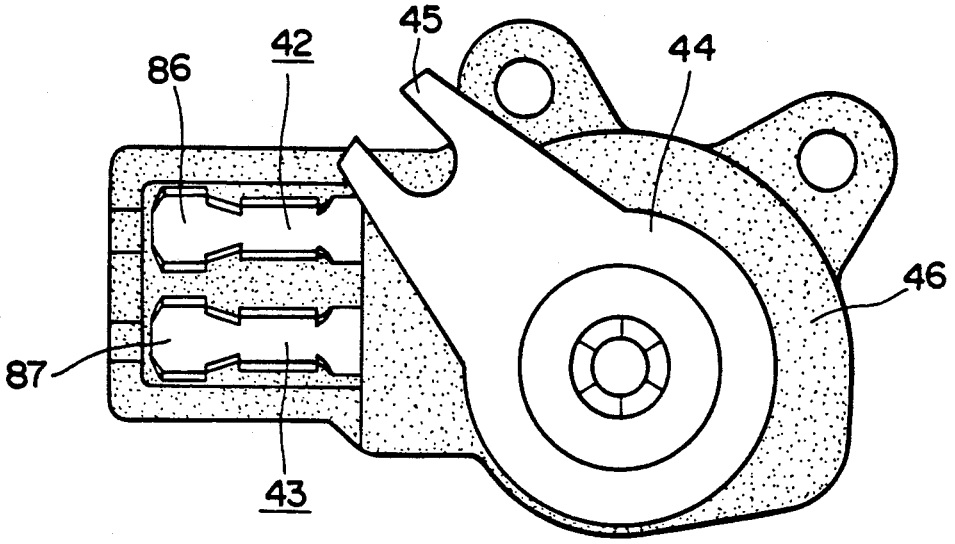
FIG. 9 is a front view of the switch.
Figure 10:
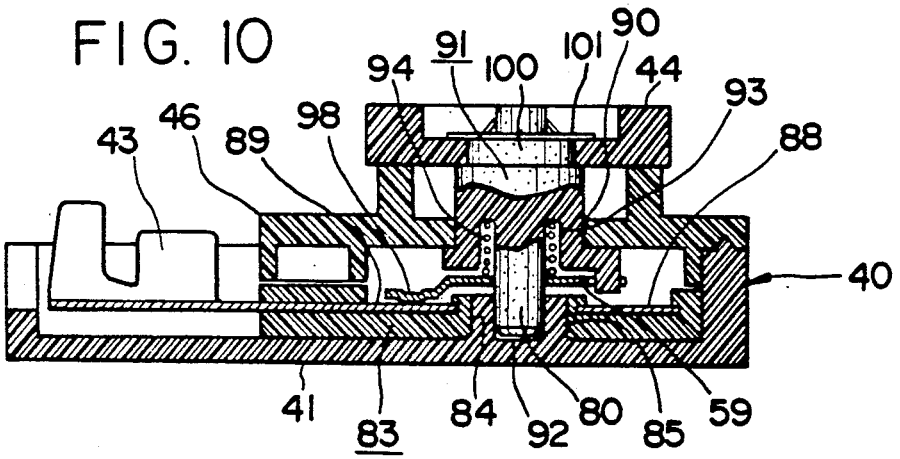
FIG. 10 is a sectional view of the switch.
Figure 11:
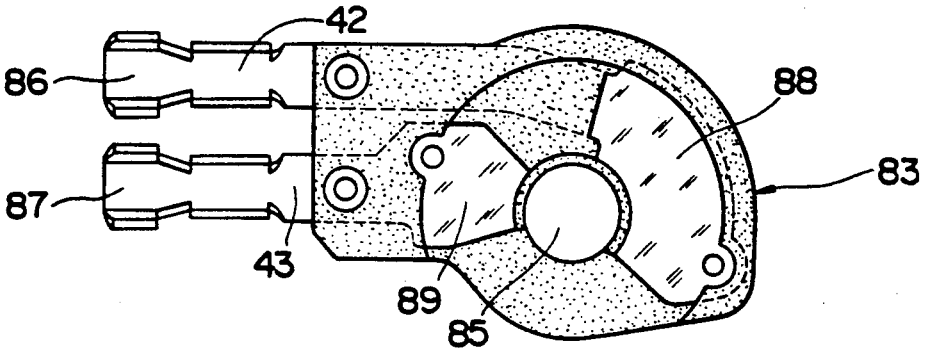
FIG. 11 is a front view of a contact assembly.
Figure 12:
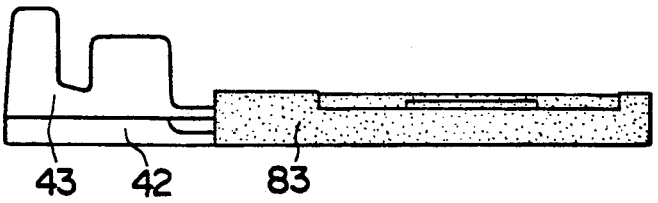
FIG. 12 is a bottom view of the contact assembly.
Figure 13:
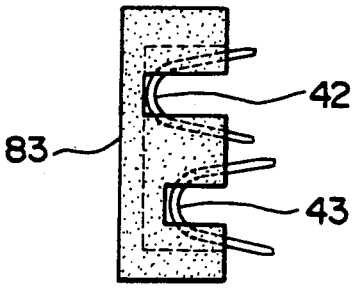
FIG. 13 is a side view of the assembly.
Figure 14:
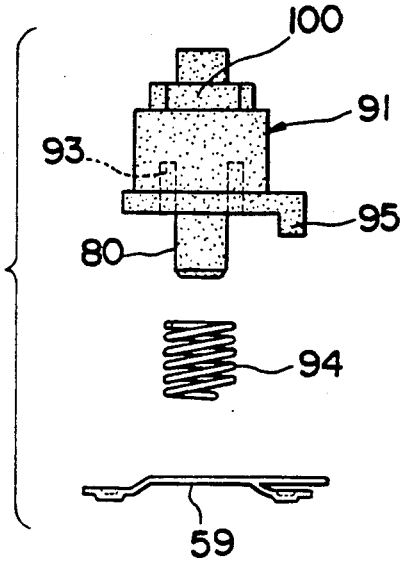
FIG. 14 is an exploded view of a rotary member and a spring.

The swell portion 13 has an upper wall 14, a lower wall 15, a bottom wall 82 and a side wall 28, and exhibits a substantially C-shaped longitudinal sectional shape (FIG. 5), as shown in the sectional views of FIGS. 7 and 8. As shown in FIGS. 7 and 8, a recess 16 facing downward is formed on the depth side of the lower wall 15 (on the right side in FIGS. 7 and 8) and a shaft 17 which is in parallel with the moving direction a of the striker 8 described above is disposed in the recess 16. A synthetic resin wedge 18 having an inclined upper surface 63 which is substantially in parallel with the lower surface of the bridge portion 11 of the striker 8 is fitted idlely in such a manner as to be capable of moving to the right and left. The length of the wedge 18 is smaller than that of the recess 16 and is always biased by a spring 19 to an entrance 64 side of the guide groove 12 described above. Accordingly, under the door opening state shown in FIG. 7, the wedge 18 is positioned on the entrance 64 side but when the door is closed, the wedge 18 moves to the inner side due to its abuttment with the bridge portion 11 as shown in FIG. 8. In consequence, the front side of the wedge 18 is firmly clamped between the upper surface 63 of the wedge 18 and the lower surface of the upper wall 14 and shake at the time of closing of the door can thus be prevented.

The entrance 64 of the guide groove 12 is wider than the depth portion and exhibits a flare-like shape as a whole which is similar to that of the bridge portion 11. A buffer material 20 to which the bridge portion 11 strikes is disposed on the depth side of the guide groove 12.

The entrance 64 side of the upper wall 14 is shaped in a substantially annular cylinder portion 65. The arcuate inner wall 66 at the lower part of this cylinder portion 65 has a free tip 67 and this free tip 67 is meshed with an engagement portion 68 formed on the upper wall 14. A cylinder portion 69 is likewise formed on the lower wall 15 as in the upper wall 14 and the tip 71 of the arcuate inner wall 70 of this cylinder portion 69 is meshed with an engagement portion 72 of the lower wall 15. A flexible member 73, 74 such as rubber is fitted into each cylinder portion 65, 69. The flexible members 73 and 74 are connected integrally with each other by a connecting member 75 (see FIG. 2).

When the door is open as shown in FIG. 7, the arcuate inner walls 66 and 70 are expanded by the respective flexible members 73 and 74. The gap between the arcuate inner walls 66 and 70 under the expanded state is greater than the width of the front end portion of the bridge portion 11 but is narrower than the width at the rear end portion. When the bridge portion 11 enters the guide groove 12, the rear end portion of the bridge portion 11 pushes the arcuate inner walls 66, 70 so that they move within the range of the gaps 76, 77 and clamp flexibly and from above and below the rear end portion of the bridge portion 11. Accordingly, the bridge portion 11 of the striker 8 is held firmly both on its front and rear sides.

Figure 3:
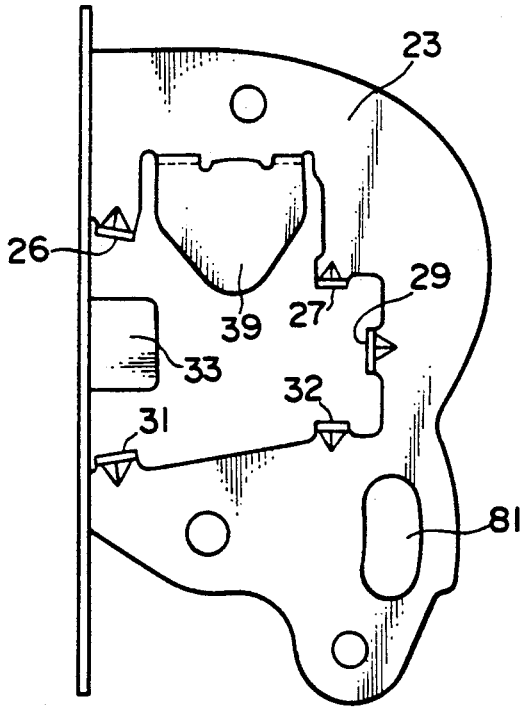
FIG. 3 is a rear view of a back plate.

A metallic back plate 23 is disposed on the back of the body 1. The back plate 23 is equipped on one of its sides with a bent portion 34 which is bent at right angles on the back side (see FIGS. 3 and 6).

A window hole 24 which is a little greater than the swell portion 13 is formed in the back plate 23. Retainers 26, 31 coming into contact with the upper and lower walls of the entrance 64 portion of the swell portion 13, retainers 27, 32 coming into contact with the upper and lower walls on the depth side of the swell portion 13 and a retainer 29 coming into contact with the side wall 28 of the swell portion 13 are formed in the window hole 24. These retainers reinforce the respective walls of the swell portion 13. In other words, when the front side of the bridge portion 11 and its rear side are firmly held by the upper wall 14 and the wedge 18 and by the arcuate inner walls 66, 70, respectively, the strong force in the swelling direction acts on each wall of the swell portion due to the reaction, and each retainer described above receives this force. Part of the bent portion 34 is bent so as to form a retainer 33 which supports from above the connecting member 75 of the flexible members 73, 74 to prevent their fall-off.

Figure 2:
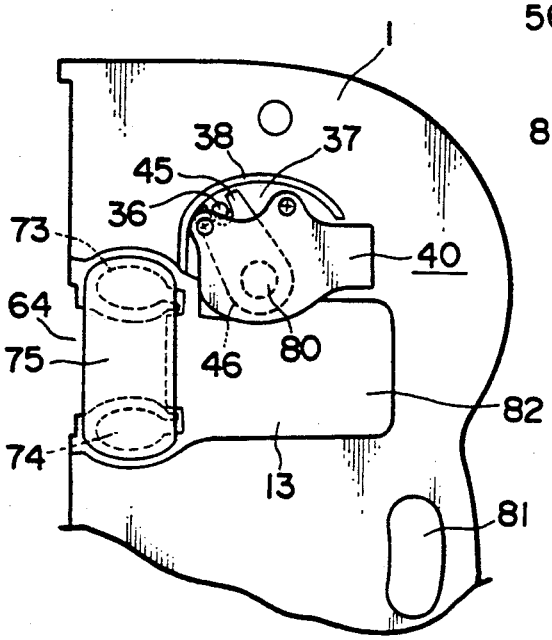
FIG. 2 is a rear view of the body.

A box 37 for storing the switch 40 which detects the rotating position of the latch 3 is formed at the upper position of the swell portion 13 on the back side of the body 1 (FIG. 2). The upper part of this box 37 is partitioned by an arc-like enclosure wall 38 which is made of a synthetic resin and integral with the body 1 and its lower part, by the upper wall 14 of the swell portion 13. The back side of the switch box 37 is covered with a cover 39 formed integrally with the back plate 23 (FIG. 4). Though the switch 40 may be fixed inside the box 37, it is suitably fixed by a screw to the cover 39. If the box 37 is formed on the back surface side of the body 1, it is possible to obtain a lock device which can be assembled easily without increasing the size of the body 1.

The switch 40 includes a synthetic resin case 41 and a cover 46 to be put onto the case 41. A contact assembly 83 is fitted into the case 41. The contact assembly 83 is formed by insert-molding a pair of metallic contact members 42 and 43 into a synthetic resin. A through-hole 85 fitting to the outer periphery of a shaft cylinder 84 of the case described above is formed at the center of the contact assembly 83. Each of the metallic contact members 42, 43 has a cord connection portion 86, 87 and a contact surface 88, 89.

Figure 15:
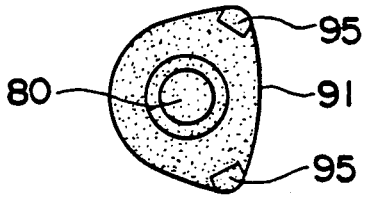
FIG. 15 is a bottom view of the rotary member.
Figure 16:
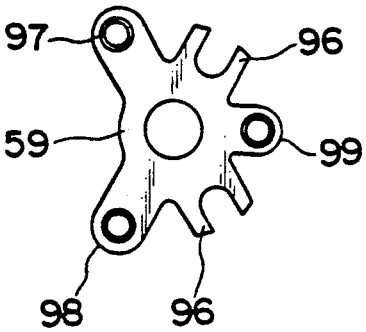
FIG. 16 is plan view of a movable contact.
Figure 17:
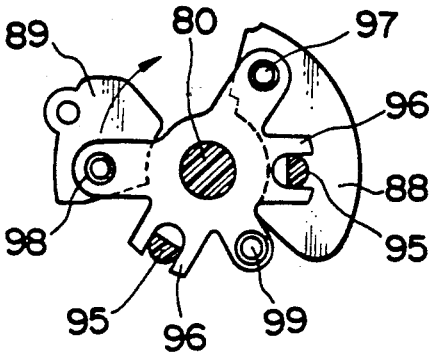
FIG. 17 is a diagram showing the relationship between the movable contact and a contact surface.

A shaft hole 90 is formed at the center of the cover 46 and a rotary member 91 is fitted rotatably to the shaft hole 90. A shaft 80 whose lower end is pivoted to the shaft hole 92 is formed integrally with the rotary member 91. The axis of the shaft 80 is positioned on the same axial line as the shaft 5 of the latch 3. A ring-like groove 93 is formed around the periphery of the shaft 80 and a coil spring 94 is fitted into the ring-like groove 93. A pair of protuberances 95 are formed on the lower surface of the rotary member as shown in FIG. 15.

A rotary contact member 59 is fitted to the shaft 80. The rotary contact member 59 has bifurcate portions 96 that mesh with the protuberances 95 described above. Three legs 97, 98, 99 are formed on the rotary contact member 59. Among them, the legs 97 and 98 are switch contacts which come into contact with the contact surfaces 88, 89 and the remaining leg 99 serves as a support leg for preventing shake. The rotary contact member 59 is always biased to the fixed switch contact surfaces 88, 89 by the coil spring 94.

According to this structure wherein the rotary contact member 59 is biased to the contact surfaces 88, 89 by the coil spring 94, it is possible to shorten the legs 97, 98 for the contact and to reduce the size of the switch as a whole. In other words, resiliency is generally imparted to contact legs in general in order to establish satisfactory contact with the contact surfaces and this resiliency becomes greater with an increasing length of the legs. However, if the length of the legs is increased, there occurs the problem, on the contrary, in that the contact mechanism becomes great in scale. Therefore, if the rotary contact member 59 is biased to the contact surfaces 88, 89 by the spring 94, the contact having short legs can be obtained.

Indicentally, three contacts and three legs are sometimes formed for the contact assembly 83 and rotary contact member 59 described above.

An odd-shaped engagement portion 100 is formed at the upper part of the rotary member 91 and the rotary lever 44 is fitted to this odd-shaped protuberance 100 is fixed by a lock metal 101. A bifurcate portion 45 is formed at the tip of the lever 44.

A protuberance 36 that projects into the switch box 37 through the window hole 35 formed in the body 1 is provided to the rotary portion of the latch 3 (FIGS. 1, 5) and the tip of this protuberance 36 is meshed with a bifurcate portion 45 of the lever 44 described already. Therefore, when the latch 3 rotates due to its engagement with the striker 8, the lever 44 rotates through the protuberance 36 and the rotating state of the latch 3 can be detected. Accordingly, the open/close state of the door can be confirmed, and a room lamp, a passive seat belt, and the like, can be controlled.

The intermediate portion of an open lever 50 is fitted rotatably by a shaft 52 on the upper back side of the body 1. As shown in FIG. 4, the left end of the open lever 50 meshes with a rotary lever 51 which is connected to an open handle (not shown) of the door. The upper end of a link 49 equipped with an elongated hole 78 at its lower end is connected to this open lever 50. A protuberance 79 fixed to the lock lever 48 is meshed with this elongated hole 78.

A pin 54 which projects to the back side through a through-hole 81 formed on the body 1 is provided to the ratchet 4 (FIG. 5). A contact plate 53 meshing with and disengaging from the pin 54 is formed on the link 49. The lock lever 48 is rotated by the operation of the rotary lever 47 or an actuator which is rotated by the locking and unlocking operation of a sill knob (or a key). In FIG. 5, the position of the protuberance 79 represented by solid line is the unlock position. When the link 49 moves up due to the rotation of the open lever 50, the contact plate 53 moves up the pin 54 to rotate the ratchet 4 and to thereby release the engagement between the latch 3 and the striker 8. The position of the protuberance 79 represented by dash line is the lock position, where the contact plate 53 does not engage with the pin 54 even when the link 49 moves up, and the door cannot be opened.

What is claimed is:

1. A lock device for a vehicle having a synthetic resin body having a surface side and a back side, comprising:

a recess formed on the surface side of the said resin body;

a latch stored in said recess and meshing with a striker fixed to a car body;

a swell portion formed on the backside of said resin body, having a C-shaped sectional shape, having an upper wall and having on its inner wall a guide groove for said striker;

an enclosure wall formed integrally with said resin body at a position above the upper wall of said swell portion on the back side of said resin body;

a box defined between a lower surface of said enclosure wall and the upper wall of said swell portion;

a switch stored in said box for detecting the rotating position of said latch; and wherein said switch includes a plurality of contact surfaces connected to contact legs, a rotary contact for short-circuiting said contact surfaces with one another and a spring for pushing said rotary contact to said contact surfaces.

2. A lock device for a vehicle according to claim 1, wherein a metallic back plate is fixed to the back side of said resin body and a cover portion for covering the back side of said box is formed integrally with said metallic back plate.

3. A lock device for a vehicle according to claim 2, wherein said switch is fixed to said cover portion and then stored in said box.

4. A lock device for a vehicle according to claim 2, wherein a protuberance projecting into said box is provided on said latch, said switch has a lever meshing with said protuberance and rotating with said latch, and the lever axis of rotation and the latch axis of rotation are disposed on the same axial line but are separate shafts.

* * * * *